United States Patent [19]

Hurst

[11] 4,020,964

[45] May 3, 1977

[54] INFANTS FEEDING BOTTLE

[75] Inventor: Eric Kenneth Hurst, London, England

[73] Assignee: Lewis Woolf Griptight Limited, Birmingham, England

[22] Filed: Sept. 10, 1975

[21] Appl. No.: 612,042

[52] U.S. Cl. ..... 215/11 C

[51] Int. Cl.[2] ..... A61J 9/00

[58] Field of Search ..... 215/11 C, 11 R; 248/102; 128/252

[56] References Cited

UNITED STATES PATENTS

| | | | |
|---|---|---|---|
| 3,655,083 | 4/1972 | Eberhardt | 215/11 C |
| 3,677,429 | 7/1972 | LaBarge | 215/11 C |
| 3,782,578 | 1/1974 | Ballin | 215/11 C |
| 3,844,436 | 10/1974 | Hurst | 215/11 C |
| 3,858,738 | 1/1975 | Hurst | 215/11 C |

*Primary Examiner*—Ro E. Hart

[57] ABSTRACT

An infants feeding bottle comprising a container for liquid, a teat securable onto the container, a detachable teat cap enclosing the teat before use and a closure member frictionally engageable within the teat and arranged to be dislodged by manipulation of the teat cap without the necessity for removal thereof from a position in which it covers the teat, the teat container, teat cap and closure member being substantially of oval section the longer dimensions of the oval sections being mutually in alignment and the teat having an outlet slit at its end the length of which is in the direction of the longer dimensions of the oval sections.

2 Claims, 2 Drawing Figures

INFANTS FEEDING BOTTLE

This invention relates to infants feeding bottles of the kind comprising a container for liquid, a teat securable onto the container, a detachable teat cup enclosing the teat before use and means whereby before use the interior of the container is isolated from the interior of the teat.

It is the object of this invention to provide an infants feeding bottle which is not only particularly convenient to use in that its correct orientation is easily determined, but also it can be inexpensively produced thus rendering disposal after use economically realistic.

According to the invention an infants feeding bottle comprises a container for liquid, a teat securable onto the container, a detachable teat cap enclosing the teat before use, and a closure member frictionally engageable within the teat before use, and arranged to be dislodged by manipulation of the teat cap into the interior of the container, with the cap covering the teat, the container, teat, teat cap and closure member being of substantially oval sections respectively, the longer dimensions of the oval sections being aligned, and the teat having an outlet slit at its end, the length of the slit being in the direction of the longer dimensions of the oval sections.

Figure 1:
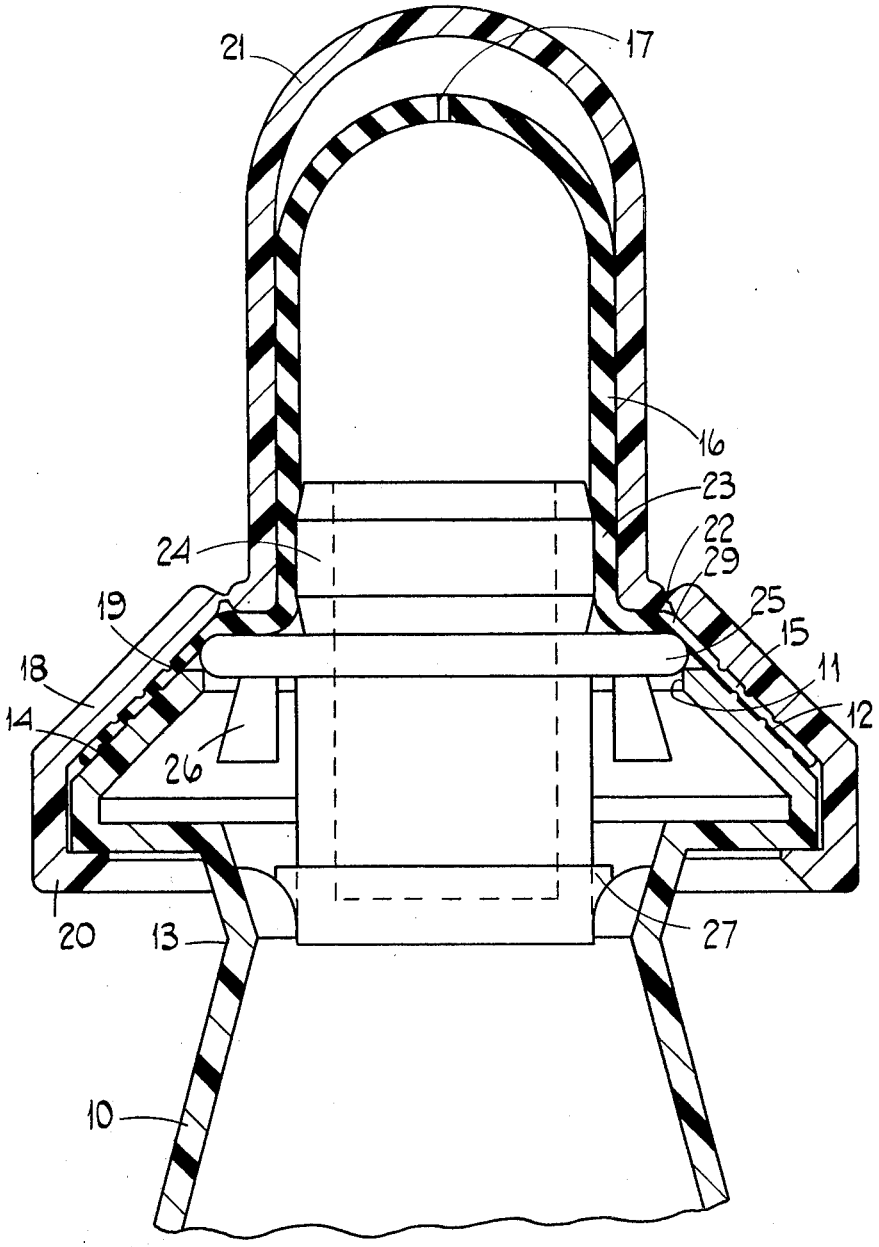
Figure 2:
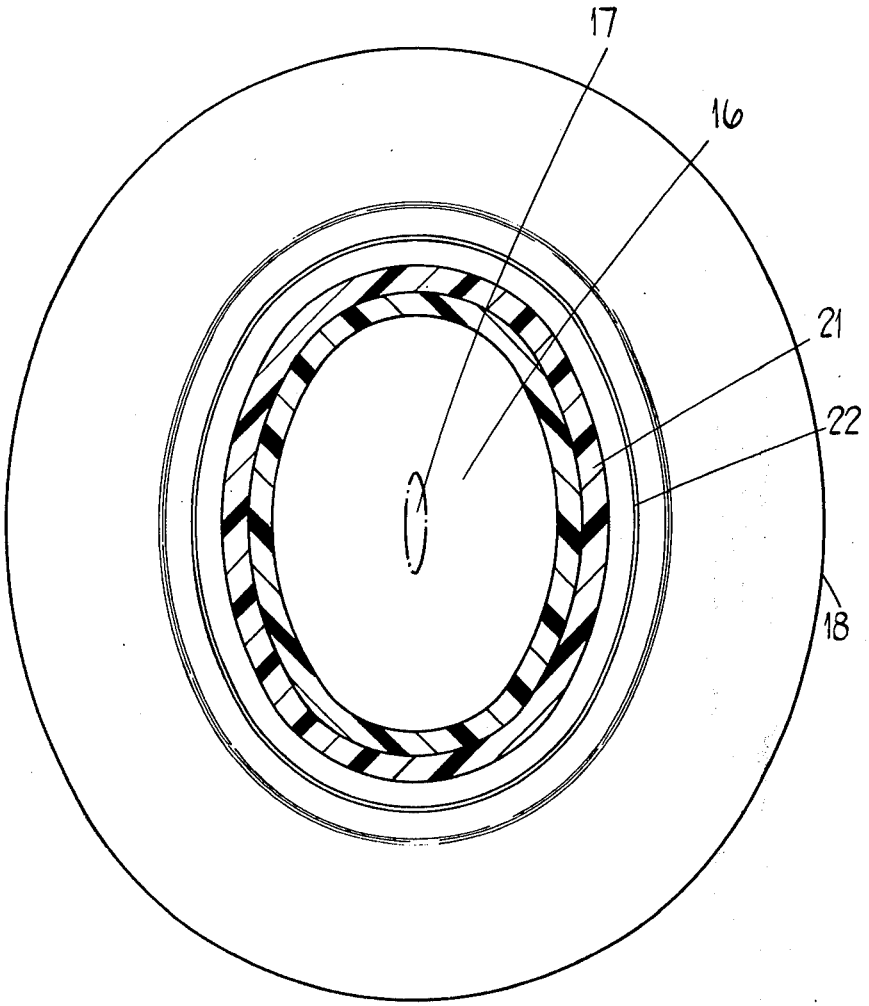

The invention will now be described by way of example with reference to the accompanying drawing, in which FIG. 1 is a side elevation cross-sectional view of an infants feeding bottle, constructed in accordance with the invention and shown in the sealed condition, FIG. 2 is a cross-sectional view through the teat.

The feeding bottle illustrated comprises a container 10 having an opening 11 surrounded by a frusto conical seating 12. The seating is formed on the external surface of an enlarged mouth portion of the container which is defined by a narrow neck portion indicated generally at 13. The surface of the seating 12 is formed with ribs 14. Engaging on the seating surface 12 is a flange 15 of a teat 16. In the condition shown the teat is somewhat deformed in shape as will be described. The flange 15 is formed by a flare portion at one end and the other end is domed and provided with a single outlet 17. This outlet 17 is in the form of a slit in the center of the end of the teat 16.

To retain the teat flange 15 in sealing engagement with the seat 12 of the container 10 there is an attachment part 18. The attachment part has an internal surface matching that of the seating 12 and having integral ribs 19 similar to those of the seating 12. The ribs 14 and 19 tend to deform the teat flange 15 so as to retain it firmly in place in tight sealing engagement with the seating 12. The attachment part has an undercut flange 20 arranged to engage under the portion of the container on which the seating 12 is formed. To allow the attachment part 18 to be fitted to the container the edge of the undercut flange is chamfered as shown. Both the container and the attachment part are formed from resilient materials to allow snap engagement to be accomplished as will be described.

Formed integrally with the attachment part 18 is a teat cap 21. These parts are connected together by an integral continuous thin severable portion 22. This portion 22 provides a connecting zone which when it is intact prevents ingress of dirt to that portion of the teat 16 which is immediately within it. The attachment part 18 and cap 21 with the connecting portions 22 are preferably formed by a moulding process from a plastics material, and the severable portion 22 has sufficient strength to withstand normal handling during transport or storage of the feeding bottle, but when required it can be broken away.

Breaking away of the severable portion 22 is accomplished by driving it inwards by the application of pressure to the top of the cap The cap 21 is tightly engaged against the exterior surface of the teat 16 in the zone indicated at 23. Such tight engagement is produced by a closure member 24 which in the sealed condition has a plug portion of generally cylindrical external configuration. The edges of such a plug portion are however shallowly chamfered as indicated but the diameter of the cylindrical zone thereof is sufficiently large to place the zone 23 of the teat in compression.

The closure member 24 is of unitary construction and is preferably moulded from a plastics material. It has an integral flange 25 from which depend a number of support lugs 26. The flange is adjacent the plug portion of the closure member, but the other end is formed with four projections 27. The edges of these are curved and they define between them four zones through which liquid stored in the interior of the container 10 can flow into the upper part of the container and ultimately into the interior of the teat when the feeding bottle has been made ready for use.

Support lugs 26, and the projections 27 provide means for supporting the closure member 24 in the position within the narrow neck portion 13 of the container. The flange 25 is however slightly larger in external dimensions and the opening 11 of the container 10. The edge of the flange 25 is rounded and it is possible to force the flange through the opening 11. Once it has passed through the opening the flange will not however return therethrough.

The rim of the cap 21 is disposed in the sealing condition shown in the drawing over th flange 25 and the teat 16 is compressed in the zone indicated at 29 between such rim of the cap 21 and the flange 25 of the closure member 24.

This provides means whereby the closure member 24 can be positively forced downwards by manipulation of the cap 21 between the sealing position shown and a ready position.

The container 10, the teat 16, the teat cap 21, the attachment part 18 and the closure member 24 are all of oval section. The longer dimensions of the oval sections are moreover aligned so that the whole assembly is narrower in one direction than it is in the other.

The slit 17 forming the outlet from the teat 16 extends in the direction of the longer dimensions of the oval sections of the respectively components.

Operations for making the feeding bottle ready for use comprise the following. In the sealing condition the severable portion 22 is complete. Severing of this is accomplished by application of pressure to the top of the cap 21. This has the effect also of driving the closure member to a position where its flange 25 passes through the opening 11 in the top of the container, and the support lugs 26 and the projections 27 engage on either side of the narrow neck portion 13 of the container. This operation is carried out with the teat cap 21 covering the teat 16 at all times.

Subsequently the teat cap 21 can be removed from over the teat 16. In practice the first operation of dislodging the closure member into the interior of the container may be carried out at a position remote from the position of use, but the cap 21 remains in place until the feeding bottle is actually to be put to use. Only immediately before such use commences is the cap 21 removed.

Removal of the cap allows the teat 16 to become undeformed. Not only is it impossible for the closure member 24 to pass the opening 11 in the container 10 but were it to do so it would be impossible for the closure member 24 to re-engage in the interior of the teat since a degree of compression of the teat takes place during such insertion and the closure member 24 has insufficient weight to allow such compressive force to be exerted. Thus a completely reliable operation of the feeding bottle is accomplished both during the process of making it ready for use and during actual use.

The method of assembling the components comprises the following. First the teat 16 is inserted into the cap 21 which has formed integrally with it the attachment part 18. Next the closure member 24 is inserted into the interior of the teat some pressure being necessary to accomplish this. Finally the whole of this assembly is secured onto the top of the container by the snap action afforded by the undercut flange 20 of the attachment part 18.

To replace the snap action afforded by the undercut flange 20 of the attachment part 18 other means for securing the attachment part to the container may be employed. Welding or the use of adhesives constitute some such methods of attachment.

The provision of an oval cross-sectional assembly together with a slit as an outlet from the teat 16 has certain advantages. The slit provides means for regulating the rate at which feeding takes place, and the oval section of the feeding bottle allows the orientation of the slit to be readily recognised.

The provision of an oval teat moreover has the advantage that it is possible by the hot latex dip process to manufacture larger numbers of teats simultaneously than is possible with teats of circular cross-section. The teats are manufactured by this process in lines carried on support bars. With oval section teats a larger number of such teats can be mounted on a bar than is possible with those of circular section.

I claim:

1. An infants feeding bottle comprising a container for liquid, a teat securable onto the container, a detachable teat cap enclosing the teat before use, and a closure member frictionally engageable within the teat before use, and arranged to be dislodged by manipulation of the teat cap into the interior of the container, with the cap covering the teat, the container, teat, teat cap and closure member being of substantially oval sections respectively, the longer dimensions of the oval sections being aligned, and the teat having an outlet slit at its end, the length of the slit being in the direction of the longer dimensions of the oval sections.

2. An infants feeding bottle as claimed in claim 1 in which the teat cap and the attachment part are connected by a severable portion.

* * * * *